United States Patent [19]

Trytek

[11] 4,218,185

[45] Aug. 19, 1980

[54] FLEXIBLE FLUID CONDUIT FOR PROPELLER SHAFT

[76] Inventor: Joseph J. Trytek, 7333 W. Gregory, Chicago, Ill. 60656

[21] Appl. No.: 892,964

[22] Filed: Apr. 3, 1978

[51] Int. Cl.[3] ..... B63H 1/18

[52] U.S. Cl. ..... 416/20 R; 416/157 R; 137/580

[58] Field of Search ..... 416/156, 20 A, 20 B, 416/20 R, 157, 231 R, 231 B; 137/580

[56] References Cited

U.S. PATENT DOCUMENTS

| | | | |
|---|---|---|---|
| 1,957,183 | 9/1933 | Schmitthenner | 416/157 |
| 2,094,838 | 10/1937 | Dalton | 416/157 |
| 2,913,002 | 8/1957 | Janas | 137/580 |
| 3,598,147 | 8/1971 | Kosaka | 137/580 |
| 3,600,102 | 8/1971 | Dirlik | 416/157 |
| 3,620,253 | 11/1971 | Walker | 137/580 |
| 3,645,644 | 2/1972 | Schwisow | 416/157 |
| 3,778,187 | 12/1973 | Wennberg | 416/157 |

FOREIGN PATENT DOCUMENTS

| | | | |
|---|---|---|---|
| 2435173 | 2/1976 | Fed. Rep. of Germany | 416/20 |
| 2718727 | 1/1978 | Fed. Rep. of Germany | 416/157 |
| 13207 | 1/1882 | Italy | 416/20 |
| 626229 | 7/1949 | United Kingdom | 416/157 |

*Primary Examiner*—Everette A. Powell, Jr.
*Assistant Examiner*—A. N. Trausch, III

[57] ABSTRACT

This disclosure is directed to a flexible fluid conduit means for directing fluid from a pressure source to a propeller of a ship for minimizing cavitation. The conduit is formed of split annular rings adapted to be mounted over a propeller shaft, the rings being interconnected to form passages for directing air pressure from the A-bracket through relative rotating seal members and into the body of the propeller. The disclosed interconnection of the annular rings permits substantial axial and bending movement of the propeller shaft without loss of air. Being submersed, the conduit is hydraulically balanced such that the force of water pressure tending to open the seal members is always less than the force tending to close the seal members.

5 Claims, 2 Drawing Figures

FLEXIBLE FLUID CONDUIT FOR PROPELLER SHAFT

BACKGROUND OF THE INVENTION

Discharge of air through the propeller blades of ships is believed to reduce cavitation. In the past, this air has been directed through the propeller shaft to the propeller and out of its blades. In ships having A-bracket supported propeller shafts, a flexible conduit mounted coaxially on the shaft for directing air from the bracket to the propeller is believed desirable.

Such a conduit presents substantial design problems. First, the conduit must be interconnected between a rigid A-bracket and the rotating propeller. Such necessitates a relative rotating seal which is subjected to varying external water pressure and varying air pressure within the conduit. Second, the propeller and its shaft are subject to axial movement of, in some cases, one and one-quarter inches as well as radial movement. Finally, such a conduit should not interfere with sea water lubrication of the A-bracket stave bearings which journal the propeller shaft.

SUMMARY OF THE INVENTION

To overcome these design problems, the present invention includes annular rings mounted between the A-bracket and the propeller. These rings are structured and axially interconnected to define air passages which permit relative rotating, telescopic and axial movement of the propeller relative to the A-bracket without loss of air. In addition to surmounting these design problems, the present invention provides the following characteristics and capabilities:

1. A flexible conduit which transfers fluid from a fixed A-bracket to a rotating propeller while permitting axial and radial movement of the propeller;
2. A flexible air conduit utilizing relative rotating seals to form part of the fluid conduit;
3. A flexible conduit having relative rotating seals in which the seals are balanced in a manner to provide a net closing or sealing force.
4. A flexible conduit which is formed of split members permitting ease of installation and maintainance.
5. A flexible split conduit adapted for mounting on a propeller shaft without interfering with sea water lubrication of the A-bracket stave bearings.

DESCRIPTION OF THE DRAWINGS

The manner in which the foregoing objects and characteristics are achieved is disclosed in the following specification and drawings in which.

DETAIL DESCRIPTION

Figure 1:
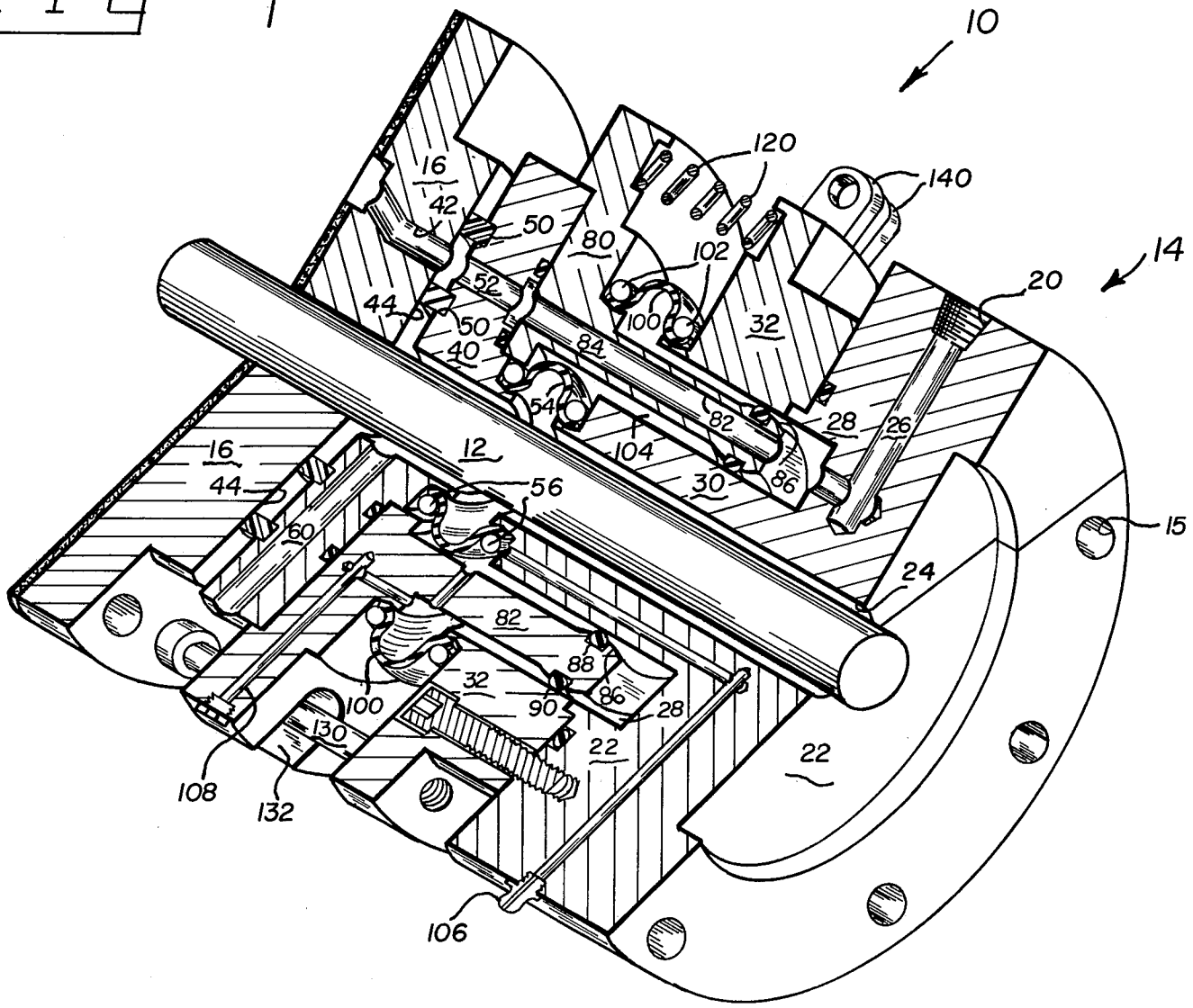
FIG. 1 is a perspective view of a preferred embodiment of my invention, with portions broken away.

As depicted in FIG. 1 the flexible conduit 10 of this invention is mounted over a propeller shaft 12 of a ship. The conduit 10 includes a body portion 14 formed of several ring members adapted to be bolted through apertures 15 (or otherwise affixed) to the A-bracket (not shown) extending from the ship's hull to rotationally support shaft 12. This body portion 14 extends rearwardly to sealingly engage a rotating mating ring 16 which is affixed to a propeller boss (not shown). Within the body portion 14 and mating ring 16 are various passages (indicated by arrows) which receive air flow from port 20 and directs air flow through mating ring 16 to the propeller boss. Conduits (not shown) within the boss then direct the air flow to the propeller blades.

As previously suggested, the propeller and mating ring 16 may move axially relative to the A-bracket of the ship. Too, relative rotation occurs between the body portion 14 and mating ring 16. Finally, the propeller shaft 12 is subjected to bending forces which must be accommodated by the conduit 10. The preferred structure of the elements accommodating such movement while maintaining a sealed air conduit will be described.

Figure 2:
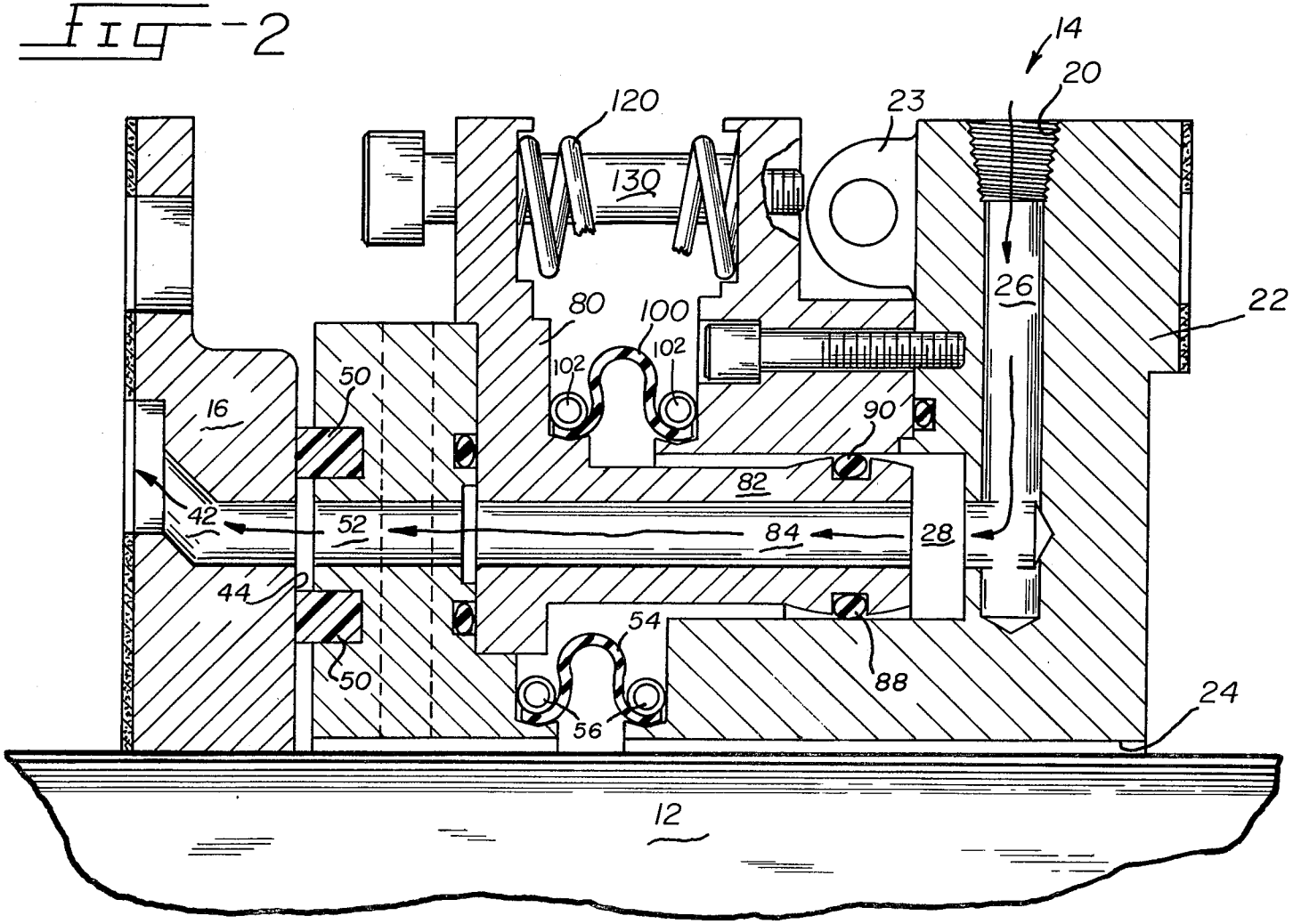
FIG. 2 is a side elevational view in section of the preferred embodiment of my invention.

Preferably each element of the seal is split or formed of two halves which may be conveniently bolted together over to shaft 12. A basic element of body 14 is the mounting member or housing 22. In cross section, shown in FIG. 2, the mounting member is generally L-shaped and has a central aperture 24 of sufficient diameter to provide a clearance between it and shaft 12. One or more ports 20 are provided on the circumference of the housing for receiving air. This air is then, by drilled passageways 26, directed radially inward to an enlarged axially extending fluid passage 28. This passage is defined by the horizontal extension 30 of mounting 22 and by an annular retainer 32 which is bolted to the mounting 22 at a plurality of locations. In assembly, the split halves of mounting member 22 are first attached to the A-bracket and bolted together through ears 23.

Next, the split mating rings 16 are bolted to each other and to the propeller boss (not shown) for rotation therewith. This mating ring has fluid passages 42 which receive air from the body portion 14 and delivers same to the boss. Since the mating ring rotates relative to body portion 14, it is provided with a flat, radially extending sealing surface 44. To seal the passage 42 from sea water, two split annular sealing rings 50, 50 are mounted upon the split primary sealing ring 40, the sealing rings 50, 50 being disposed on opposite sides of air passages 42. Preferably these sealing rings are formed of a phenolic resin-asbestos composition, commercially available. An air passage 52 of primary seal member 40 is also disposed between rings 50, 50 to mate with passage 42.

The primary sealing ring 40 is then connected to the extension 30 of mounting member 22 by an annular flexible diaphragm 54. This diaphragm may be formed of material and in the manner of diaphragms long used in stern tube seals. As shown in drawings, the opposite sides of the diaphragm 54 are mounted on lips of the primary ring 40 and on the extension 30 by circumferential cables 56. Upon assembly of the diaphragm 54, the central aperture 24 of body portion 14 is sealed to provide a passage for sea water to lubricate the propeller shaft 12 as it rotates within the rubber staves of the A-bracket. Sea water is thus allowed to pass through the A-bracket, along propeller shaft 12 within body portion 14 and out radially drilled apertures 60 of primary sealing ring 40.

With the primary sealing ring 40 and mounting means 22 installed, the fluid passage for transmitting air from port 20 to mating ring 16 can be completed. For this purpose two more split members are positioned about extension 30 to define another annular member 80 having a forward extension 82. This fluid transfer member 80 is provided with a plurality of air passages 84. The extension 82 extends forward towards passage 28 of mounting means 22 and its air passage 84 complete to air conduit between port 20 and the mating ring 16.

After installation of fluid transfer member 80, the split retainer 32 can be then bolted to the mounting ring 22. Once in place, the internal diameter of retainer 32 in conjunction with the external diameter of extension 30 defines an elongated passage 28 in which extension 82 may telescope. Thus, if the propeller shaft moves rearwardly one inch, the extension 82 can merely telescope within passage 28 and the air passage is not affected. Similarly, the end of extension 82 is curved at 86 and provided with internal and external O-rings 88 and 90. This feature of the invention seals the air passage while permitting limited bending deflections of the propeller shaft 12.

Subsequent to installation of the retainer ring 32, a second external diaphram 100 is mounted upon lips of the retainer and transfer member 80 and tightened with cables 102. The two diaphragms 54 and 100 further isolate the air passage from sea water; permit the axial movement of fluid transfer member 80; and define a cavity 104 which is filled with a high viscous fluid such as grease. This grease may be introduced into cavity 104 through a sert 106 and passages drilled in body member 22 as shown. Preferably another drilled aperture 108 in transfer member 80 is used to indicate when cavity 104 is full as grease emerges therefrom. As subsequently discussed, this grease is subjected to sea pressure through flexible diaphragms 54 and 102 and contributes to the balancing of radial seals 50.

To complete assembly of the conduit 10, a plurality of compression springs 120 are inserted between member 80 and retainer 32 at circumferentially spaced points. These springs bias sealing rings 50,50 into engagement with surface 44 of mating ring 16. Finally, a plurality of bolts 130 extend through apertures 132 of transfer means 80 for threaded engagement with retainer 32. The heads of these bolts are spaced from member 80 to permit free axial movement of that member. Yet, these bolts constrain member 80 against rotation. In addition to these specifically described elements, various O-rings may be employed as shown in the drawings to better seal the air passage from sea water. Apertured ears such as those shown at 140 are mounted on opposite sides of each split member and may be used to bolt the parts together.

In operation, air delivered to port 20 is transmitted through the air passages described into the mating ring 16. To preclude loss of air, the seal rings 50,50 must remain in sealing contact with surface 44 during normal operation and upon axial movement of the propeller and mating ring 16 relative to the A-bracket. This sealing engagement requires proper dimensioning of the areas upon with sea pressures and air pressure are imposed. Generally, it is anticipated that the conduit will be subjected to approximately 20 psi of sea pressure. A summation of the area on which sea water is tending to open seal members 50 and those areas in which water is acting to close the seal members will reveal that the sea water will always impose a net closing force even upon maximum extension of the conduit as limited by the ends of bolts 130. Such area summation includes the radial areas within cavity 104 since grease in this cavity is subjected to sea pressure through flexible diaphrams 54 and 100. In addition, the springs 120 will impose additional sealing force. Finally a summation of the radial areas within the main air passages 26, 28, 84, 52, and 42 will reveal a net sealing force at most air pressures.

From this description of the preferred embodiment, those skilled in the art will appreciate that the flexible conduit, as disclosed permits relative rotaion, axial and bending movement between opposite ends of the conduit. Too, various modifications will suggest themselves to persons skilled in the art.

I claim:

1. A split fluid conduit adapted to be mounted about a propeller shaft for transmitting air from an A-bracket to a propeller for minimizing cavitation, said conduit permitting axial and bending movement of said propeller shaft, said conduit comprising:

(a) An annular mounting member having an aperture extending therethrough for mounting over a propeller shaft, said member adapted to be attached to an A-bracket of a ship and having fluid conduit for receiving fluid and transferring same towards said propeller;

(b) A fluid transfer member having conduit means extending into the fluid conduit of said annular mounting member, said conduit means being coupled to said fluid conduit by means permitting relative axial and bending movement between said conduit means and said fluid conduit, said coupling including sealing means for precluding loss of fluid;

(c) Seal means interposed between said fluid transfer member and said propeller, said seal means including passage means for transferring fluid from the fluid transfer member to said propeller, and a radially extending sealing surface on opposite sides of said passage means for precluding loss of fluid.

2. An apparatus as recited in claim 1 in which the areas of said conduit are proportioned and balanced in a manner such that fluid pressure imposes a net closing force on said seal means.

3. An apparatus as recited in claim 2 in which said conduit means is isolated from sea water by circumferential flexible diaphrams mounted externally and internally of said conduit means to define a cavity for receiving a high viscous fluid.

4. An anticavitation fluid conduit for propeller shafts, supported by A-brackets, said conduit comprising:

(a) An annular mounting ring member adapted to be attached to an A-bracket so as to extend coaxially of a shaft towards a propeller, said ring having fluid passage means for receiving fluid pressure and transmitting same towards said propeller;

(b) An annular fluid transfer member having fluid passages therein, said transfer member telescoping into the fluid passage means of said mounting ring for permitting relative telescopic and bending movement of said members;

(c) Radially spaced sealing means affixed to said transfer member and sealingly connected to said propeller, said sealing means having a fluid passage in the propeller.

5. An apparatus as recited in claim 4 in which the areas of said conduit are proportioned and balanced in a manner such that fluid pressure imposes a net closing force on said seal means.

* * * * *